US005354339A

United States Patent [19]

Bodnar

[11] Patent Number: 5,354,339

[45] Date of Patent: Oct. 11, 1994

[54] FABRIC STABILIZER

[76] Inventor: George Bodnar, 61 Rodney Drive, Knoxfield, Victoria 3180, Australia

[21] Appl. No.: 924,043

[22] PCT Filed: Apr. 12, 1991

[86] PCT No.: PCT/AU91/00139

§ 371 Date: Sep. 2, 1992

§ 102(e) Date: Sep. 2, 1992

[87] PCT Pub. No.: WO91/16490

PCT Pub. Date: Oct. 31, 1991

[30] Foreign Application Priority Data

Apr. 12, 1990 [AU] Australia ..... PJ9625
Jun. 8, 1990 [AU] Australia ..... PK0536

[51] Int. Cl.[5] ..... C08K 5/06

[52] U.S. Cl. ..... 8/115.6; 8/930; 252/8.6; 252/8.9; 428/260

[58] Field of Search ..... 8/115.6, 930; 252/8.6, 252/8.9; 428/260

[56] References Cited

U.S. PATENT DOCUMENTS

| | | | |
|---|---|---|---|
| 3,961,125 | 6/1976 | Suminokura et al. | 428/261 |
| 4,121,009 | 10/1978 | Chakrabarti | 428/260 |
| 4,309,510 | 1/1982 | Kleber | 525/6 |
| 4,383,063 | 5/1983 | Rees | 524/91 |
| 4,399,245 | 8/1983 | Kleber et al. | 524/108 |
| 4,797,127 | 1/1989 | Marten et al. | 8/115.6 |
| 4,844,709 | 7/1989 | Marten | 8/115.6 |
| 4,845,140 | 7/1989 | Marten | 524/245 |
| 4,861,502 | 8/1989 | Caswell | 252/8.6 |

FOREIGN PATENT DOCUMENTS

| | | |
|---|---|---|
| 146688 | 6/1952 | Australia . |
| 147754 | 8/1952 | Australia . |
| 1279141 | 1/1991 | Canada . |
| 2426404 | 12/1975 | Fed. Rep. of Germany . |
| 2234978 | 9/1990 | Japan . |
| 1391793 | 4/1975 | United Kingdom . |

*Primary Examiner*—Johann Richter
*Assistant Examiner*—Catherine S. Kilby Scalzo
*Attorney, Agent, or Firm*—Kerkam, Stowell, Kondracki & Clarke

[57] ABSTRACT

Method of stabilizing fabrics by impregnation with a water soluble stiffening agent so that the fabric will not readily stretch in any direction. The water soluble stiffening agent is prepared by producing a mixture of Poly Vinyl Alcohol and water and diluting such with Ethanol. The materials produced thereby is particularly suited for embroidery work, for accurate cutting of materials, and in the process of applique.

19 Claims, No Drawings

FABRIC STABILIZER

The present invention relates particularly, although by no means exclusively to enhancing the properties of materials so as to make them more suitable for needlework in domestic and small scale applications, and more particularly in relation to embroidering.

To date the main difficulty experienced in performing general sewing, and addressed by this invention, relates to the uneven finish due to the stretch of the fabrics. As the sewing machine transports the fabric, the loose nature of usual weaving patterns and fabrics used makes it likely that the fabric will not always move in step with the sewing machine's transport movement. Fabric stretch being the reason for this erratic behaviour.

To embroider patterns on a material various aids have been used. In one system of the prior art the material is stretched between two hoops before embroidering a pattern within the area of the hoops. By moving the hoops along the length of the material the whole pattern is thus completed. In utilising this technique it is essential that the material is evenly stretched. Although the hoop system tends to work well with stiff materials, real problems are experienced with fine and stretchy materials. This is because of the difficulty experienced in maintaining an even tension over the whole pattern. Where one tension is not maintained the finished product will exhibit unsightly ripples. A further drawback in the utilization of this technique is that the user is unable to make use of the hoops for working on a pattern along the edges of a material.

It can thus be seen that this system is quite restrictive, applying only to stiff materials and to work where the patterns are located well away from the edges of the material.

In another system of the prior art the material to be embroidered is prepared by laminating it with a sheet of stiff material. Although the problems associated with fine and stretchy materials are alleviated by the use of a stiff backing this excludes its use in embroidering on fine garments where delicate appearance is essential.

To overcome this shortcoming, it is known in the prior art to laminate a backing material which is paper based, e.g. waxed paper, wherein the backing material is removed after the embroidery is completed. Once again this system includes drawbacks in that the removal of the backing material is difficult to achieve without damage to the material itself. Furthermore, the finished product often contains unsightly fragments of the backing layer and rippling of the fabric still occurs since the fabric can still move relative to the paper.

In another system it has been proposed to use starch to stiffen materials. However, because of the different characteristics of the starch, to achieve the same degree of stiffness, one is required to use substantial amounts of starch to achieve an equivalent product. This results in a brittle and flaky product. Thus whenever the starch treated material is manipulated it rapidly loses its stiffness since the starch readily breaks up. The heavily starched materials thus have a tendency to shed starch flakes which eventually interfere with the machine mechanism. Another drawback in using starch to prepare fabrics caused by its physical characteristics (that is, hard and brittle), results in the needle cutting the fibres and thus weakening the material as well as presenting an unsightly appearance. This is because the material treated with starch does not permit the needle in penetration of the material to push aside the adjacent fibres.

In light of the foregoing problems and the disadvantages presented by the above prior art systems, it is an object of this invention to provide enhanced properties to difficult materials so as to enable easy needlework application. This is achieved by dealing with the direct cause rather than trying to compensate for it. Logical solution is in preventing the stretch of the fabrics during sewing operations.

The present invention relates to a method of preparation of materials for needlework by their impregnation with a water soluble stiffening agent. Generally the agent is applied by either a brush-on, wipe-on or spray-on application of areas which will undergo needlework.

The invention furthermore comprises of a method of impregnating materials with a water soluble stiffening agent, embroidering or sewing over the impregnated areas and washing of the material on completion of embroidery/sewing.

It has been found that an application of heat treatment to impregnated areas result in their rapid drying. However, heat treatment is not an essential feature as the impregnated surface will dry naturally over a longer period of time.

It has been noted that the properties of the said agent are such that there will be no permanent bonding or interference between the fabric and the stiffening fluid agent since the agent is solvent and non-reactive on dies used on fabrics (irrespective of whether the fabric is natural, synthetic or a combination of these). Thus the above invention provides a non-intrusive method which is equally applicable to stiff, stretchy or fine materials.

To aid fast preparation the agent is prepared by dissolving a concentrate in alcohol, for example, ethanol or similar solvent, thus forming the stabiliser base.

Generally a water soluble stiffening agent solution is prepared by producing a 15% mixture of Poly Vinyl Alcohol PVA (hydrolysation between 86-89 tool % and viscosity 30-50 cps) and 85% water. Prior to use the initial solution is diluted with Ethanol (99.8% strength) in the ratio of 1:2 i.e. one part of initial solution to two parts of Ethanol. If desired a fragrance may be added to the concentrate.

The use of a water based PVA diluted with alcohol (e.g. ethanol) has a two pronged effect. Firstly, it stops bacterial growth within the PVA so that it is not required to further treat the material. Secondly, the alcohol serves as a penetrating agent by lowering the viscosity of the solution thus carrying the PVA into every available space in the material and then drying in place. Thus diluting the initial water based PVA mixture with alcohol results in a superior products.

The use of starch in this connection is unsuitable because it is dimensionally too large to penetrate the small spaces between the strands forming a single fibre in the material.

The method although particularly suited to embroidery work is equally adaptable and useful in many other sewing applications. A further advantage in using the stabiliser is found in the cutting and sewing of the materials. Doing so not only improves the accuracy of cutting, but it also stops fraying of certain fabrics. Another use of stabilising is in the process of applique where the component parts are stabilised, then heated with an iron to adhere together and onto the garment. It is then a simple matter to complete the sewing operations. Thus the secondary effect of the stabiliser is adhesive. In summary, the treatment of fabrics by impregnation with a water soluble agent stabilises the fabric so that the fabric will not readily stretch in any direction, behaving as if it were a solid piece of material, yet soft enough to bend during the sewing and allowing the needle to penetrate the fabric easily. The stabilised fabric can now be transported by the sewing machine foot uniformly and accurately, without damage to the machines mechanism, nor requiring any special skill required by the operator.

When all sewing operations are completed, to return the stabilised fabric to its original state it is necessary to remove all traces of the stabiliser. Since the stabiliser is water-soluble all that is required is to rinse the fabric on completion of the sewing. It is sufficient to perform this even in cold water. Washing step will dissolve and remove all of the stabiliser from the treated fabric.

As can be seen from the above, the stabilising or stiffening of the fabrics will not only solve one of the biggest problems experienced in sewing, but will also make many operations possible hitherto considered otherwise, and will accomplish this simply and cheaply. As a result it is now possible for anyone to afford to produce garments of high quality with ease. It is also noted that stabilising of fabrics will also be the preferred method in industrial situations in some instances where for short runs or special problems it will prove cheaper and more practical than investing in expensive new machines.

It is also noted that the invention includes a method of preparing a stiffening agent as well as the agent itself that is used for the method outlined above for preparing a material by its impregnation therewith. The stiffening agent includes a mixture of water soluble solution. The mixture preferably includes Poly Vinyl Alcohol. Furthermore this mixture includes addition of further alcohol. The alcohol is preferably Ethanol.

The invention furthermore includes the fabric prepared by the method or the stiffening solution.

I claim:

1. A method of treating a textile material for needlework, embroidery, or any other sewing operation comprising, impregnating a section of the textile material to be subjected to the sewing operation with a stiffening agent comprising an aqueous solution of a polyvinyl alcohol (PVA), allowing the impregnated textile material to dry for subsequent use in the sewing operation, performing the sewing operation on the textile material with the stiffening agent providing the only stiffening for the textile material, and after the sewing operation has been completed, removing at least a portion of the stiffening agent.

2. The method defined in claim 1 comprising, removing substantially all the stiffening agent after completing the sewing operation.

3. The method defines in claim 1, wherein the PVA has a hydrolysation of up to 89 mol. %.

4. The method defined in claim 3, wherein the PVA has a hydrolysation in the range of 86–89 mol. % and a viscosity in the range of 30–50 centipoise.

5. The method defined in claim 1, wherein the stiffening agent comprises an aqueous solution of a PVA and a wetting agent to improve penetration of the PVA into the material.

6. The method defined in claim 2, wherein the stiffening agent comprises an aqueous solution of a PVA and a wetting agent to improve penetration of the PVA into the material.

7. The method defined in claim 3, wherein the stiffening agent comprises an aqueous solution of a PVA and a wetting agent to improve penetration of the PVA into the material.

8. The method defined in claim 4, wherein the stiffening agent comprises an aqueous solution of a PVA and a wetting agent to improve penetration of the PVA into the material.

9. The method defined in claim 1, wherein the stiffening agent includes an aqueous solution of a PVA and an alcohol prepared by producing an initial solution comprising the PVA and the water and diluting the initial solution with the alcohol.

10. The method defined in claim 9, wherein the initial solution comprises 15% PVA and 85% water.

11. The method defined in claim 10 comprising, diluting the initial solution with the alcohol in the ratio of one part of the initial solution to two parts of the alcohol.

12. The method defined in claim 9, wherein the PVA has a hydrolysation of up to 89 mol. %.

13. The method defined in claim 12, wherein the PVA has a hydrolysation in the range of 86–89 mol. % and a viscosity in the range of 30–50 centipoise.

14. The method defined in claim 9 wherein the alcohol comprises ethanol.

15. The method defined in claim 5, wherein said wetting agent is an alcohol.

16. The method defined in claim 6, wherein said wetting agent is an alcohol.

17. The method defined in claim 7, wherein said wetting agent is an alcohol.

18. The method defined in claim 8, wherein said wetting agent is an alcohol.

19. The method defined in claim 18, wherein the alcohol comprises ethanol.

* * * * *